US009251777B2

(12) United States Patent
Kim

(10) Patent No.: US 9,251,777 B2
(45) Date of Patent: Feb. 2, 2016

(54) COMPLEX SPEAKER SYSTEM

(76) Inventor: Dong Wan Kim, Seongnam-si (KR)

( * ) Notice: Subject to any disclaimer, the term of this patent is extended or adjusted under 35 U.S.C. 154(b) by 239 days.

(21) Appl. No.: 14/003,757

(22) PCT Filed: Mar. 6, 2012

(86) PCT No.: PCT/KR2012/001628
§ 371 (c)(1),
(2), (4) Date: Nov. 11, 2013

(87) PCT Pub. No.: WO2012/121533
PCT Pub. Date: Sep. 13, 2012

(65) Prior Publication Data

US 2014/0056436 A1 Feb. 27, 2014

(30) Foreign Application Priority Data

Mar. 7, 2011 (KR) ..... 10-2011-0020117

(51) Int. Cl.
*G10K 11/00* (2006.01)
*H04R 1/24* (2006.01)

(52) U.S. Cl.
CPC ..... *G10K 11/002* (2013.01); *H04R 1/24* (2013.01)

(58) Field of Classification Search
CPC ..... G10K 11/002; H04R 1/24
USPC ..... 381/71.7
See application file for complete search history.

(56) References Cited

U.S. PATENT DOCUMENTS

| | | | | |
|---|---|---|---|---|
| 5,003,610 | A * | 3/1991 | Adachi et al. | 381/431 |
| 2001/0019617 | A1* | 9/2001 | Morecroft | 381/423 |
| 2002/0094107 | A1* | 7/2002 | Cork | 381/412 |
| 2002/0125065 | A1 | 9/2002 | Bank | |

FOREIGN PATENT DOCUMENTS

| | | | |
|---|---|---|---|
| JP | S56123687 | U | 9/1981 |
| JP | S62117896 | U | 7/1987 |
| JP | S62167487 | U | 10/1987 |
| JP | H10341491 | A | 12/1998 |
| JP | 2002016993 | A | 1/2002 |
| JP | 2002518911 | A | 6/2002 |
| KR | 1987-0000732 | Y1 | 2/1987 |
| KR | 88-3746 | U | 4/1988 |
| KR | 89-22178 | U | 11/1989 |

OTHER PUBLICATIONS

Japanese Office Action for JP2013-557643 mailed Sep. 24, 2014.
Office Action corresponding to KR10-2011-0020117, dated Feb. 20, 2012.
Notice of Registration corresponding to KR10-2011-0020117, dated Sep. 18, 2012.
International Search Report and Written Opinion corresponding to PCT/KR2012/001628, dated Oct. 10, 2012.

* cited by examiner

*Primary Examiner* — Sonia Gay
(74) *Attorney, Agent, or Firm* — Hauptman Ham, LLP

(57) ABSTRACT

A complex speaker system includes a conical speaker including a recessed section at a surface thereof and configured to receive a sound-playback signal and reproduce sound and a distributed mode speaker installed in the recessed section of the conical speaker and configured to share the sound-playback signal input into the conical speaker.

15 Claims, 3 Drawing Sheets

COMPLEX SPEAKER SYSTEM

RELATED APPLICATIONS

The present application is a National Phase of International Application Number PCT/KR2012/001628, filed Mar. 6, 2012, and claims priority from Korean Application Number 10-2011-0020117, filed Mar. 7, 2011.

TECHNICAL FIELD

The present disclosure relates to a complex speaker system, and more particularly, to a complex speaker system including a conical speaker and a distributed mode speaker, which are coupled to each other to faithfully reproduce an original sound.

BACKGROUND

A speaker is an apparatus for reproducing a sound from an electrical signal. Reviewing a process of converting the electrical signal into the sound, the electrical signal is converted into a vibration of a diaphragm, the vibration of the diaphragm generates a wave of condensation, i.e., a sound wave to air, and the sound wave is transmitted to a human's ear through radiation.

In general, the speaker is used by coupling a low frequency reproduction speaker and a high frequency reproduction speaker. Both of the low frequency reproduction speaker and the high frequency reproduction speaker use conical speakers. A large conical speaker, which is referred to as a woofer, is used to reproduce a low frequency sound, and a small conical speaker, which is referred to as a tweeter, is used to reproduce a high frequency sound.

In order to faithfully reproduce a whole range of a sound frequency, multiple speakers are combined and used. For example, when a space is sufficient, the low frequency speaker and the high frequency speaker are separately installed, and when the space is insufficient, the high frequency speaker is disposed in the vicinity of the low frequency speaker or disposed in the low frequency speaker. In particular, since a large space cannot be used when the space is restricted like inside a vehicle, a coaxial speaker structure, in which the high frequency speaker is installed in the low frequency speaker, may be employed. That is, the small conical speaker, which is the tweeter, is installed in the large conical speaker, which is a woofer. In the coaxial speaker structure, since the tweeter is installed in the woofer, a speaker installation space can be reduced.

However, since the sound wave generated from the conical speaker is a correlation sound, a sound wave collision phenomenon, i.e., an interference phenomenon, occurs. When the interference phenomenon is generated between the sound waves generated from the woofer and the tweeter, which are conical speakers, sound resolution of the speaker system is remarkably degraded. In particular, in a vehicle in which a plurality of speakers having the coaxial speaker structure is used, this interference phenomenon is relatively severe.

SUMMARY

Technical Problem

In some embodiments of the present invention, a sound wave interference of a coaxial speaker structure is at least partially solved.

In some embodiments of the present invention, an increase of spatial utilization of a coaxial speaker is achieved.

Solution to Problem

Some embodiments of the present invention provide a complex speaker system having a coaxial speaker structure in which a conical speaker and a distributed mode speaker are combined. The conical speaker has a recessed section at a front surface thereof, receives a sound-playback signal, and generates a sound wave. The distributed mode speaker is installed in the recessed section of the conical speaker, and receives the same sound-playback signal as the sound-playback signal input into the conical speaker.

The complex speaker system according to some embodiments of the present invention further includes a filter configured to remove a frequency component of a low-pitched tone band from the sound-playback signal input into the distributed mode speaker and output the frequency component to the distributed mode speaker.

In some embodiments, the filter removes a frequency component in a range of 20 Hz to 600 Hz. In some embodiments, the filter removes a frequency component in a range of 20 Hz to 500 Hz. In some embodiments, the filter removes a low-pitched tone frequency component in a range of 20 Hz to 400 Hz.

In some embodiments, the filter includes a condenser, or is implemented as a circuit.

In some embodiments, the distributed mode speaker includes a rectangular diaphragm. In some embodiments, the rectangular diaphragm includes a honeycomb structure.

In some embodiments, the distributed mode speaker and the conical speaker are coaxially disposed.

In some embodiments, when coupling a conical speaker and a distributed mode speaker, a support frame having one end coupled to a frame of the conical speaker is provided, and a frame of the distributed mode speaker is coupled to the other end of the support frame. In some embodiments, the support frame includes a rotation-locking unit configured to lock rotation of the distributed mode speaker.

In some embodiments, when coupling a conical speaker and a distributed mode speaker, a fixing rod connected to one side of an outer circumference of the conical speaker and directed inward the conical speaker is provided, and the distributed mode speaker is coupled to an end of the fixing rod.

In some embodiments, the distributed mode speaker employs the frame of the conical speaker. For example, a voice coil section of the distributed mode speaker is insertable into a permanent magnet of the conical speaker to be vibrated.

In some embodiments, the conical speaker and the distributed mode speaker employ neodymium (NdFeB) as a material of the permanent magnet.

Advantageous Effects

According to a complex speaker system according to some embodiments of the present invention, as the distributed mode speaker having no sound wave interference with the conical speaker is installed in the recessed section of the conical speaker, the original sound is faithfully reproduced.

In addition, according to a complex speaker system according to some embodiments of the present invention, as spatial utilization of the coaxial speaker structure is increased, the speaker system is easily installed even in a narrow space.

[Reference Signs List]

| | |
|---|---|
| 100, 100A, 100B, 100C: complex speaker system | |
| 200: conical speaker | 210: cone |
| 220, 320: damper | 230, 330: voice coil section |
| 240, 340: permanent magnet | 250, 350: holding frame |
| 252, 352: nut | 300: distributed mode speaker |
| 310: planar diaphragm | 360: double-sided tape |
| 500: support frame | 600: fixing rod |

DESCRIPTION OF EMBODIMENTS

A complex speaker system according to some embodiments of the present invention is described in detail below with reference to accompanying drawings.

Figure 1:
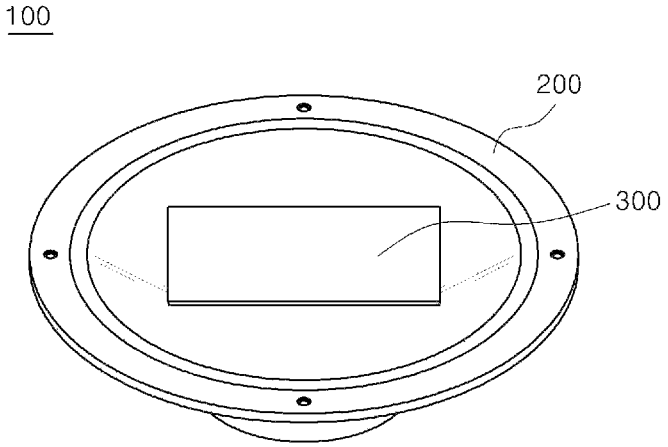
FIG. 1 is a schematic perspective view of a complex speaker system according to some embodiments of the present invention.

FIG. 1 is a schematic perspective view of a complex speaker system according to some embodiments of the present invention.

As illustrated in FIG. 1, the complex speaker system 100 includes a distributed mode speaker 300 and a conical speaker 200. The conical speaker 200 includes a recessed section. The distributed mode speaker 300 is coupled to the recessed section of the conical speaker 200.

The conical speaker 200 receives a sound-playback signal (an electrical signal) to vibrate a conical diaphragm, reproducing sound.

The distributed mode speaker 300 receives a sound-playback signal (an electrical signal) to vibrate a diaphragm, reproducing sound, in the similar manner as the conical speaker 200. The distributed mode speaker 300 uses a flat-plate shaped diaphragm.

In some embodiments, the conical speaker 200 and the distributed mode speaker 300 are coupled to each other such that a front end of the distributed mode speaker 300 protrudes forward more than a front end of the recessed section of the conical speaker 200. However, as illustrated in FIG. 1, in order to reduce a volume of the complex speaker system 100, in some embodiments, the front end of the distributed mode speaker 300 is disposed inside more than the front end of the recessed section of the conical speaker 200, i.e., installed in the recessed section of the conical speaker 200.

Figure 2:
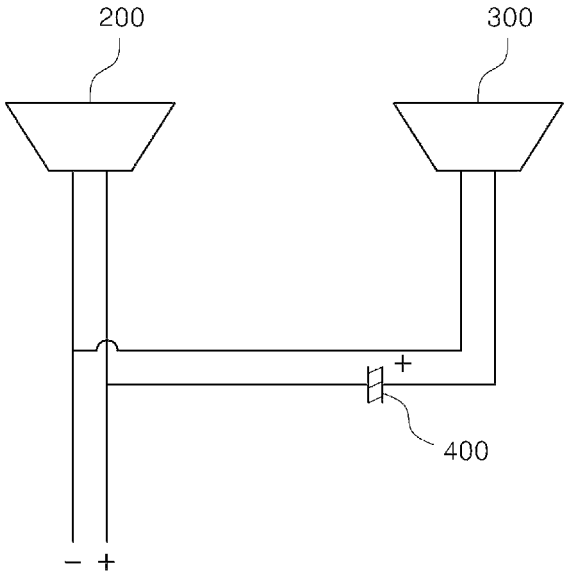
FIG. 2 is a wiring diagram for transmitting a sound-playback signal to a complex speaker system according to some embodiments of the present invention.

FIG. 2 is a wiring diagram for transmitting the sound-playback signal to a complex speaker system according to some embodiments of the present invention.

As illustrated in FIG. 2, the distributed mode speaker 300 and the conical speaker 200 share the sound-playback signals. For example, signal lines of the sound-playback signals input into the conical speaker 200 and the distributed mode speaker 300 are connected in parallel.

In some embodiments, in the input signal of the distributed mode speaker 300, a low frequency component of a low-pitched tone band is removed from the sound-playback signal input into the conical speaker 200. To this end, a filter 400 is used. In some embodiments, the filter 400 employs a condenser. For example, in the case of the complex speaker system mounted in a vehicle, a condenser having a range of 4.7 to 10 microfarad (μF) is used. In some embodiments, in order to more precisely control the low frequency component, a separate filter circuit is configured.

In some embodiments, the low frequency component removed by the filter 400 is selected from a range of 20 Hz to 600 Hz. This is because, reviewing frequency operation characteristics of the distributed mode speaker 300, clean sound quality cannot be made at a frequency of 600 Hz or less, in particular, 500 Hz or less, and thus, the entire sound quality of the complex speaker system is degraded. However, since recognition ability of the sound quality differs from individual to individual, in some embodiments, the range of the removed low frequency component is appropriately selected within a range of 20 Hz to 600 Hz in consideration of characteristics of the installed complex speaker system.

While the filter 400 is connected to a + or − signal line connected to the distributed mode speaker 300, in some embodiments, the filter 400 is connected to the + signal line that functions as a signal input line.

Figure 3:
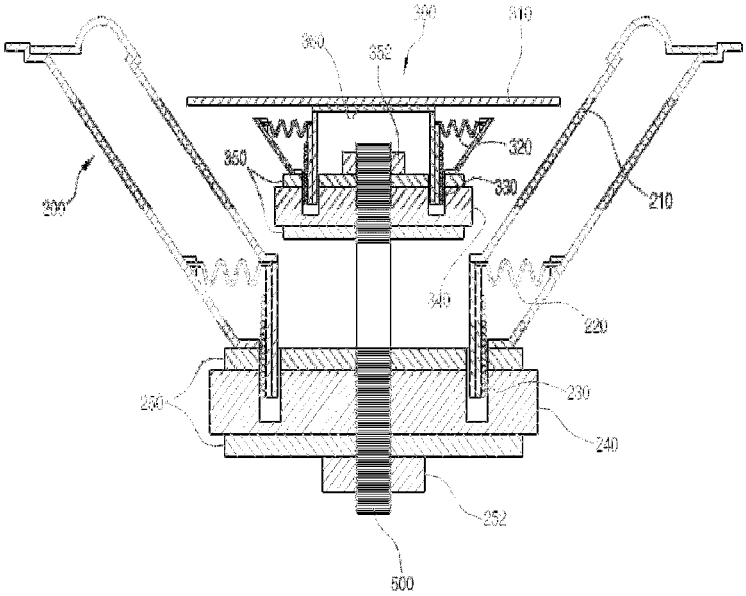
FIG. 3 is a cross-sectional view of a complex speaker system according to a first embodiment of the present invention.

FIG. 3 is a cross-sectional view of a complex speaker system according to a first embodiment of the present invention.

As illustrated in FIG. 3, in the complex speaker system according to the first embodiment, a distributed mode speaker holding frame 350 configured to support a permanent magnet 340 of the distributed mode speaker is connected to a conical speaker holding frame 250 configured to support a permanent magnet 240 of the conical speaker by a support frame 500 through threaded engagement.

In FIG. 3, the support frame 500 coupled to the distributed mode speaker holding frame 350 is integrated with the distributed mode speaker holding frame 350, other than the threaded engagement. In this case, while the volume of the distributed mode speaker 300 is increased, the distributed mode speaker 300 is more easily coupled to or separated from the conical speaker 200.

The conical speaker 200 generally includes a frame (not shown), an edge (not shown), a cone 210), a damper 220), a voice coil section 230), the permanent magnet 240), the conical speaker holding frame 250), and so on.

The frame (not shown) functions as a central shaft surrounding the cone 210, the damper 220 and the voice coil section 230 and supporting the entire weight of a unit driver. In particular, the frame offsets a vibration of the unit driver generated when the cone 210 is vibrated forward and rearward by current flowing through the voice coil section 230. In some embodiments, the frame is formed of aluminum, steel, reinforced plastic, or the like.

The edge (not shown), which may be referred to as a front surround, is adhered to the frame (not shown) at an external round section of a front surface of the cone 210 and prevents introduction or discharge of air between the inside and the outside of the frame (not shown). In some embodiments, the edge is formed of a soft and flexible material such as rubber, sponge, or the like.

The cone 210 is attached to the voice coil section 230 and moved in the same direction according to movement of the voice coil section 230, and the cone 210 is also moved by amplitude of the voice coil section 230. Since the cone 210 is configured to make sound, the cone 210 is formed of a thin, lightweight and strong material. While a paper is generally used at the beginning, a plastic material such as polypropylene or the like is used to improve disadvantages of the paper after that, and in recent times, an alloy material including a metal is used due to strength.

The sound quality differs depending on a material of the cone 210. In general, the paper material generates soft and warm sound quality, and the plastic or metal material generates a light and cool sound quality.

The damper 220 functions as a rear surface protection frame of the cone, which is a kind of spring, to prevent excessive amplification of the cone 210 and the voice coil section 230 and generation of abnormal sound. The damper 220 generally has a web shape and elasticity. In some embodiments, the damper 220 is generally formed of a corrugated yellow cotton thread or the like.

The voice coil section 230 is a section through which electricity flows. The voice coil section 230 is attached to a central portion of the cone 210, and at least a portion thereof is installed in the permanent magnet 240. When the sound-playback signal (the electrical signal) made by the amplifier passes through the voice coil section 230, the voice coil section 230 moves forward and rearward by a magnetic field of the permanent magnet 240, and at this time, the cone 210 coupled to the voice coil section 230 also moves in the same direction. As described above, the sound is made by the vibration of the voice coil section 230 and thus the vibration of the cone 210.

In some embodiments, the permanent magnet 240 is formed of a material such as alnico, ferrite, or the like. In some embodiments, the permanent magnet 240 is formed of neodymium (NdFeB). The neodymium makes a strong magnetic field using a small amount, and has a high mechanical strength to sufficiently prevent breakage thereof. As described above, since the neodymium can reduce the volume of the permanent magnet 240 and thus the entire volume of the complex speaker system can be remarkably reduced, the volume can be remarkably reduced when the complex speaker system is mounted in a narrow space, for example, the inside of the vehicle.

The conical speaker holding frame 250 functions as a strut to prevent a direct contact between the frame (not shown) of the unit driver and the permanent magnet 240. In addition, a through-hole having a female thread is formed at a center thereof, and the support frame 500 is threadedly engaged with the through-hole. The conical speaker holding frame 250 is generally formed of a non-magnetic conductive metal such as aluminum or the like.

The distributed mode speaker 300 includes a damper 320, a voice coil section 330, the permanent magnet 340, the distributed mode speaker holding frame 350, and so on, like the conical speaker 200. However, the distributed mode speaker 300 includes a rectangular planar diaphragm 310, unlike the cone 210, which is a diaphragm, of the conical speaker 200.

The distributed mode speaker 300 is inserted and coupled to the recessed section of the conical speaker 200, and coupled to the conical speaker 200 via the support frame 500. Both ends of the support frame 500 have male threads. When the male threads are rotated and inserted into the female threads of the conical speaker holding frame 250 and the distributed mode speaker holding frame 350, nuts 252 and 352 are threadedly engaged with the male threads of the support frame 500 from opposite sides.

When the conical speaker 200 and the distributed mode speaker 300 reproduce sound to repeat vibrations and shakings, the threaded engagement of the support frame 500 may be released. In order to prevent the release, in some embodiments, an anti-rotation unit (not shown) is further installed at the support frame 500, the holding frames 250 and 350, or the nuts 252 and 352. In some embodiments, the anti-rotation unit (not shown) is constituted by a pin, a wedge, or the like. In some embodiments, a washer (not shown) is simply inserted between the nuts 252 and 352 to prevent rotation of the distributed mode speaker 300.

Since the diaphragm 310 of the distributed mode speaker 300 has a flat surface, the diaphragm 310 is randomly vibrated in all directions, and generates little interference with the sound wave of the conical speaker as well as the sound wave generated from the distributed mode speaker 300 itself.

When the diaphragm 310 of the distributed mode speaker 300 is configured to protrude from the front end of the conical speaker 200, an area of the diaphragm 310 of the distributed mode speaker 300 is larger or smaller than a front cross-section of the conical speaker 200. However, when the distributed mode speaker 300 is installed in the recessed section of the conical speaker 200, a long side of the diaphragm 310 of the distributed mode speaker 300 should be smaller than an inner diameter of an opening section of the cone 210. As a result, blocking of sound generated in the conical speaker 200 and propagated forward by the distributed mode speaker 300 can be reduced.

When the distributed mode speaker 300 is installed in the recessed section of the conical speaker 200, a signal line of the sound-playback signal separated from the conical speaker 200 and parallelly connected to the distributed mode speaker 300 passes through the diaphragm of the conical speaker 200 or passes through a through-hole formed in the support frame 500 to be connected to the voice coil section 330 of the distributed mode speaker.

In some embodiments, the diaphragm 310 of the distributed mode speaker 300 has a honeycomb structure. For example, the diaphragm 310 is formed as a structure configured by pressing a honeycomb core of an aluminum material with a reinforced plastic or a paper. Since efficiency of the diaphragm of the honeycomb structure is increased as the material is lightweight, in some embodiments, the diaphragm is formed by pressing the papers. In this case, a peculiar sound of the distributed mode speaker, for example, "kong-kong" or the like, is reduced.

In the distributed mode speaker 300, a double-sided tape 360 configured to couple the diaphragm 310 and the voice coil section 330 is installed between the diaphragm 310 and a front surface of the voice coil section 330. The diaphragm 310 coupled to the voice coil section 330 via the double-sided tape 360 is vibrated according to forward and rearward vibrations of the voice coil section 330.

In FIG. 3, while the through-hole configured to couple the support frame 500 is configured to pass through both of the permanent magnet 240 and the conical speaker holding frame 250 to couple the nut 252 of the outside of the through-hole, in some embodiments, the through-hole passes to a range not passing through an upper holding frame of the conical speaker holding frame 250, an upper holding frame of the conical speaker holding frame 250 and the permanent magnet 240, or a lower holding frame of the conical speaker holding frame 250, coupling the support frame 500. In this case, the nut 252 is unnecessary.

MODE FOR CARRYING OUT SOME EMBODIMENTS OF THE INVENTION

Figure 4:
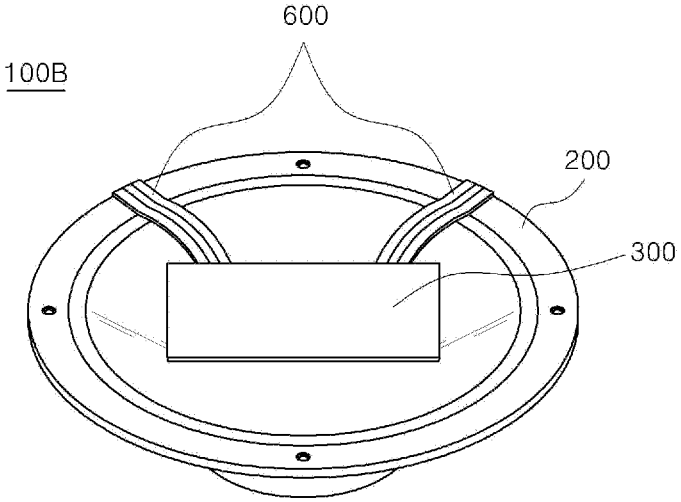
FIG. 4 is a cross-sectional view of a complex speaker system according to a second embodiment of the present invention.

FIG. 4 is a cross-sectional view of a complex speaker system according to a second embodiment of the present invention.

As illustrated in FIG. 4, a fixing rod 600 is installed at one side of an outer circumference of the conical speaker 200. In some embodiments, one side of the fixing rod 600 is fixed to the edge or the frame. The distributed mode speaker 300 is coupled and fixed to the other side of the fixing rod 600. Here, a length of the other side of the fixing rod 600 is adjusted such that the distributed mode speaker 300 is disposed on the same axis as the conical speaker 200.

In some embodiments, one fixing rod 600 is enough. In this case, a width or a thickness of the fixing rod 600 should be substantially large. However, in order to stably support the distributed mode speaker 300, in some embodiments, two or more fixing rods are provided. In this case, the width or the thickness of the fixing rod 600 is reduced.

The distributed mode speaker 300 is fixed to the fixing rod 600 by the double-sided tape (not shown) at the other side of the fixing rod 600. In some embodiments, a ring coupler, a screw coupler, or the like, is provided at the other side of the fixing rod 600, and a corresponding coupler is provided at the distributed mode speaker 300. The couplers are coupled to each other to fix the distributed mode speaker 300 to the fixing rod 600.

Figure 5:
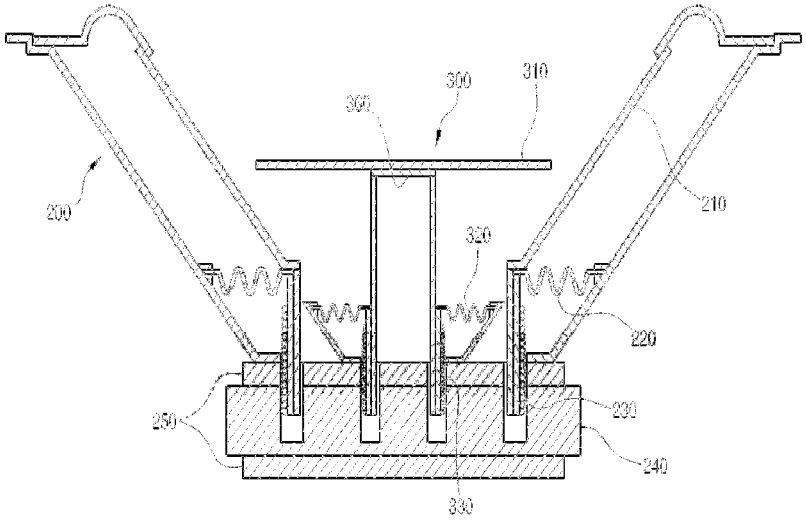
FIG. 5 is a cross-sectional view of a complex speaker system according to a third embodiment of the present invention.

FIG. 5 is a cross-sectional view of a complex speaker system according to a third embodiment of the present invention.

As illustrated in FIG. 5, the distributed mode speaker 300 includes the diaphragm 310, the damper 320, the voice coil section 330 and the double-sided tape 360. The complex speaker system illustrated in FIG. 5 does not include the permanent magnet 340, the distributed mode speaker holding frame 350, the nuts 252 and 352 and the support frame 500, unlike the complex speaker system illustrated in FIG. 3.

In the complex speaker system illustrated in FIG. 5, the distributed mode speaker 300 is fixed to the frame of the conical speaker 200. That is, in the similar manner as the conical speaker 200, the distributed mode speaker 300 is inserted into the permanent magnet 240 and the conical speaker holding frame 250 of the conical speaker 200 to be vibrated in the similar manner as the vibration mechanism of the conical speaker 200, reproducing the sound. That is, the planar diaphragm 310 is coupled to the voice coil section 330, and as the voice coil section 330 moves in the permanent magnet 240 of the conical speaker 200, the planar diaphragm 310 is also moved according to thereto to be vibrated in the same direction.

According to the configuration illustrated in FIG. 5, the complex speaker system can be simplified, and the weight and volume thereof can be reduced.

The complex speaker system according to some embodiments of the present invention having the configuration illustrated in FIGS. 3 to 5 operates as follows.

Since the sound-playback signals input into the conical speaker 200 are parallelly connected to the distributed mode speaker 300, the conical speaker 200 and the distributed mode speaker 300 share the sound source.

In the sound-playback signal separated from the conical speaker 200 and input into the distributed mode speaker 300, a low-pitched tone band in a range of 20 Hz to 600 Hz is removed by the filter 400 and input into the distributed mode speaker 300. As described above, when the low frequency component of the sound-playback signal input into the distributed mode speaker 300 is removed, it is possible to solve a problem such as a decrease in sound quality caused by large vibrations of the diaphragm 310 of the distributed mode speaker 300. A layered sound is related to generation of ideal sound when a correlation sound generated by the conical speaker and a non-correlation sound generated by the distributed mode speaker are reproduced at a band of 500 Hz to 5 kHz or 600 Hz to 5 kHz.

Since the conical speaker 200 generates a wavelength having a specific wave front as the cone 210 is vibrated forward and rearward and the distributed mode speaker 300 generates a wavelength having little wave front as the rectangular diaphragm 310 is irregularly vibrated, reproduction sound of the distributed mode speaker 300 does not interfere with reproduction sound of the conical speaker 200. As a result, a user can hear the sound having sound quality remarkably improved in comparison with the speaker structure in which the low-pitched tone woofer and the high-pitched tone tweeter are coaxially coupled. In addition, as the reproduction problem of the low-pitched tone band due to characteristics of the distributed mode speaker can be solved by the filter, original sound-playback through the conical speaker and the distributed mode speaker can be further improved.

Some embodiments of the present invention have been achieved to provide sound quality improved more than the sound quality output from the coaxial speaker structure in which the low-pitched tone woofer and the high-pitched tone tweeter are coaxially coupled or the speaker structure in which the low-pitched tone woofer and the high-pitched tone tweeter are disposed adjacent to each other in parallel. Accordingly, in some embodiments, the high-pitched tone tweeter is separately installed at a side surface of the woofer, and in this case, in comparison with the speaker structure in which the distributed mode speaker is installed in the woofer, better sound quality can be provided. Further, the distributed mode speaker can also be installed in the high-pitched tone tweeter adjacent to the woofer, and in this case, better sound quality can be provided. As described above, the ideal sound is generated when both of the correlation sound generated by the conical speaker and the non-correlation sound generated by the distributed mode speaker are reproduced at a band of 500 Hz to 5 kHz or 600 Hz to 5 kHz. In some embodiments, since a frequency distribution of the woofer that outputs the low-pitched tone band and the tweeter that outputs the high-pitched tone band exists in the band of 500 Hz to 5 kHz or 600 Hz to 5 kHz, the distributed mode speaker is coupled to the tweeter as well as the woofer.

In addition, while the present disclosure describes the structure in which the distributed mode speaker is installed in the woofer or tweeter in order to accomplish spatial efficiency, disposition in which the distributed mode speaker is disposed adjacent to the outside of the woofer or the tweeter is not excluded.

Some embodiments of the present invention have been discussed above with reference to the accompanying drawings. However, those skilled in the art will readily appreciate that the detailed description given herein with respect to these figures is for explanatory purposes as the present disclosure extends beyond these limited embodiments. For example, it should be appreciated that those skilled in the art will, in light of the teachings of the present disclosure, recognize a multiplicity of alternate and suitable approaches, depending upon the needs of the particular application, to implement the functionality of any given detail described herein, beyond the particular implementation choices in the following embodiments described. That is, there are numerous modifications and variations of the present disclosure that are too numerous to be listed but that all fit within the scope of the present disclosure.

INDUSTRIAL APPLICABILITY

The complex speaker system according to some embodiments of the present invention is suitable for using in a vehicle, a house, a cathedral, a church, a classroom, a music room, or the like.

The invention claimed is:

1. A complex speaker system, comprising:

a conical speaker including a recessed section on a surface thereof and configured to receive a sound-playback signal to reproduce a sound;

a distributed mode speaker installed in the recessed section of the conical speaker and configured to share the sound-playback signal input into the conical speaker; and a filter configured to remove a frequency component of a low-pitched tone band from the sound-playback signal input into the distributed mode speaker and output the frequency component to the distributed mode speaker.

2. The complex speaker system according to claim 1, wherein the distributed mode speaker includes a rectangular planar diaphragm.

3. The complex speaker system according to claim 2, wherein the rectangular planar diaphragm includes a honeycomb structure.

4. The complex speaker system according to claim 1, wherein the filter is configured to remove a frequency component in a range of 20 Hz to 600 Hz.

5. The complex speaker system according to claim 1, wherein the filter includes a condenser.

6. The complex speaker system according to claim 1, wherein an axial center of the distributed mode speaker and an axial center of the conical speaker are disposed on the same line.

7. The complex speaker system according to claim 1, further comprising a support frame including one end coupled to a frame of the conical speaker, wherein a frame of the distributed mode speaker is coupled to the other end of the support frame.

8. The complex speaker system according to claim 7, wherein the support frame further includes a rotation-locking unit configured to lock rotation of the distributed mode speaker.

9. The complex speaker system according to claim 1, further comprising a fixing rod connected to one side of an outer circumference of the conical speaker and directed inward the conical speaker, wherein the distributed mode speaker is coupled to an end of the fixing rod.

10. The complex speaker system according to claim 1, wherein the conical speaker and the distributed mode speaker employ a magnet formed of neodymium (NdFeB).

11. The complex speaker system according to claim 1, wherein the distributed mode speaker uses a frame of the conical speaker.

12. The complex speaker system according to claim 11, wherein a voice coil section of the distributed mode speaker is inserted into a permanent magnet of the conical speaker to be vibrated.

13. A complex speaker system, comprising:

a conical speaker including a recessed section on a surface thereof and configured to receive a sound-playback signal to reproduce a sound;

a distributed mode speaker installed in the recessed section of the conical speaker and configured to share the sound-playback signal input into the conical speaker; and a support frame including one end coupled to a frame of the conical speaker, wherein a frame of the distributed mode speaker is coupled to the other end of the support frame.

14. The complex speaker system according to claim 13, wherein the support frame further includes a rotation-locking unit configured to lock rotation of the distributed mode speaker.

15. A complex speaker system, comprising:

a conical speaker including a recessed section on a surface thereof and configured to receive a sound-playback signal to reproduce a sound;

a distributed mode speaker installed in the recessed section of the conical speaker and configured to share the sound-playback signal input into the conical speaker; and a fixing rod connected to one side of an outer circumference of the conical speaker and directed inward the conical speaker, wherein the distributed mode speaker is coupled to an end of the fixing rod.

* * * * *